US008343898B2

(12) United States Patent
Ruhr et al.

(10) Patent No.: US 8,343,898 B2
(45) Date of Patent: Jan. 1, 2013

(54) METHOD OF LUBRICATING CONVEYORS USING OIL IN WATER EMULSIONS

(75) Inventors: Richard Oliver Ruhr, Buffalo, MN (US); Jeffery S. Hutchison, Stillwater, MN (US); Chad Aaron Thompson, Farmington, MN (US); Eric Daniel Morrison, W. St. Paul, MN (US); Jason Gregory Lang, Bloomington, MN (US); Scott P. Bennett, Stillwater, MN (US); Kellen Wesley Chamblee, Falcon Heights, MN (US)

(73) Assignee: Ecolab USA Inc., St. Paul, MN (US)

( * ) Notice: Subject to any disclaimer, the term of this patent is extended or adjusted under 35 U.S.C. 154(b) by 42 days.

(21) Appl. No.: 12/982,392

(22) Filed: Dec. 30, 2010

(65) Prior Publication Data

US 2011/0160109 A1 Jun. 30, 2011

Related U.S. Application Data

(60) Provisional application No. 61/291,521, filed on Dec. 31, 2009.

(51) Int. Cl.
*C10M 169/04* (2006.01)
*C10M 173/00* (2006.01)

(52) U.S. Cl. ..... 508/459; 508/433; 508/485; 508/491; 508/555; 508/562; 198/500

(58) Field of Classification Search ..... 508/459; 198/500

See application file for complete search history.

(56) References Cited

U.S. PATENT DOCUMENTS

| | | | | |
|---|---|---|---|---|
| 4,226,325 | A | 10/1980 | Vandas | |
| 4,228,889 | A | 10/1980 | Garrison | |
| 4,437,358 | A | 3/1984 | Kubo et al. | |
| 4,521,321 | A | 6/1985 | Anderson et al. | |
| 4,604,220 | A | 8/1986 | Stanton | |
| 4,769,162 | A | 9/1988 | Remus | |
| 4,828,727 | A | 5/1989 | McAninch | |
| 4,897,202 | A | 1/1990 | King | |
| 4,897,203 | A | 1/1990 | King | |
| 4,926,971 | A | 5/1990 | Egger | |
| 5,174,914 | A | 12/1992 | Gutzmann | |
| 5,175,999 | A | 1/1993 | Hara et al. | |
| 5,232,068 | A | 8/1993 | Bandy, Jr. | |
| 5,250,005 | A | 10/1993 | Matthiasson et al. | |
| 5,352,376 | A | 10/1994 | Gutzmann | |
| 5,559,087 | A | 9/1996 | Halsrud et al. | |
| 5,663,131 | A | 9/1997 | Winicov et al. | |
| 5,723,418 | A | 3/1998 | Person Hei et al. | |
| 5,863,874 | A | 1/1999 | Person Hei et al. | |
| 5,900,392 | A | 5/1999 | Bernhard | |
| 5,925,601 | A | 7/1999 | McSherry et al. | |
| 5,932,526 | A | 8/1999 | Person Hei et al. | |
| 5,935,914 | A * | 8/1999 | Theyssen et al. | 508/517 |
| 6,207,622 | B1 | 3/2001 | Li et al. | |
| 6,214,777 | B1 | 4/2001 | Li et al. | |

(Continued)

*Primary Examiner* — Ellen McAvoy
(74) *Attorney, Agent, or Firm* — Merchant & Gould, P.C.

(57) ABSTRACT

The present disclosure generally relates to a method for lubricating conveyors using lubricant compositions with oil in water emulsions. The emulsion can be a lipophilic compound and an emulsifier. In an embodiment, the method includes applying a lubricant composition to the articulating chain and pin joint of the chain of a conveyor wherein the conveyor transports objects weighing more than about 15 kilograms, and the lubricant composition comprises an oil in water emulsion where at least one oil is not a silicone compound.

25 Claims, 6 Drawing Sheets

U.S. PATENT DOCUMENTS 6,288,012 B1 9/2001 Li et al.
6,302,263 B1 10/2001 Bennett et al.
6,310,013 B1 10/2001 Lokkesmoe et al.
6,419,078 B1 * 7/2002 Leathers ..... 198/500
6,427,826 B1 8/2002 Li et al.
6,458,053 B1 10/2002 Hill
6,475,961 B2 11/2002 Lokkesmoe et al.
6,495,494 B1 12/2002 Li et al.
6,509,302 B2 1/2003 Li et al.
6,525,005 B1 2/2003 Kravitz et al.
6,575,291 B2 6/2003 Bennett et al.
6,576,298 B2 6/2003 Bennett et al.
6,667,283 B2 12/2003 Kravitz et al.
6,673,753 B2 1/2004 Person Hei et al.
6,688,434 B2 2/2004 Johnson et al.
6,696,394 B1 2/2004 Ruhr et al.
6,743,758 B2 6/2004 Li et al.
6,756,347 B1 6/2004 Besse et al.
6,780,823 B2 8/2004 Li et al.
6,806,240 B1 10/2004 Hei et al.
6,821,568 B2 11/2004 Bennett et al.
6,855,676 B2 2/2005 Li et al.
6,915,745 B2 7/2005 Carder
7,053,026 B2 5/2006 Li
7,297,666 B2 * 11/2007 Kupper et al. ..... 508/451
7,364,033 B2 4/2008 Li et al.
7,371,711 B2 5/2008 Li et al.
7,371,712 B2 5/2008 Li et al.
7,384,673 B2 6/2008 Konegen et al.
7,384,895 B2 6/2008 Person Hei et al.
7,455,170 B2 * 11/2008 Beauchamp ..... 198/500
7,557,071 B2 7/2009 Sarkis et al.
7,585,822 B2 9/2009 Costello et al.
7,592,296 B2 9/2009 Sperling
7,600,631 B2 10/2009 Li et al.
8,119,580 B2 * 2/2012 Theyssen et al. ..... 508/431
2008/0108532 A1 * 5/2008 Kuepper Dr. et al. ..... 508/459
2008/0176778 A1 * 7/2008 Seemeyer et al. ..... 508/433
2010/0009879 A1 * 1/2010 Theyssen et al. ..... 508/431

* cited by examiner

Motor amperage for Unitizer conveyor vs time for wet mode application of 0.33% Sani-Glide

Motor amperage vs time for Unitizer conveyor for dry mode application of Emulsion 2

Amperage vs time for for Unitizer conveyor for dry mode application of Emulsion 3

METHOD OF LUBRICATING CONVEYORS USING OIL IN WATER EMULSIONS

CROSS-REFERENCE TO RELATED APPLICATIONS

This application claims benefit of Provisional Application No. 61/291,521, filed Dec. 31, 2009, which application is incorporated herein by reference.

FIELD

The present disclosure relates to a method for lubricating conveyors using oil in water emulsions. The emulsion can be a lipophilic compound and an emulsifier.

BACKGROUND

In commercial container filling or packaging operations, the containers typically are moved by a conveying system at very high rates of speed. A concentrated lubricant may be diluted with water to form an aqueous dilute lubricant solution (i.e., dilution ratios of 100:1 to 500:1), and copious amounts of aqueous dilute lubricant solutions are typically applied to the conveyor or containers using spray or pumping equipment. These lubricant solutions permit high-speed operation of the conveyor and limit marring of the containers or labels. Conveyors that transport containers that are not contained in secondary packaging may be referred to as "container conveyors."

In commercial filling operations, conveyors may also be used to transport secondary packaging. Secondary packaging refers to something that holds containers, for example crates and pallets. The secondary packaging may be fabricated from different types of materials including polymeric materials (polyethylene, polypropylene, polystryrene and acrylonitrile butadiene styrene (ABS)), cardboard, wood, and composite. Conveyors that transport containers are typically situated at about table height from the floor and may therefore be referred to as "table top conveyors," whereas conveyors that transport secondary packaging with containers are often embedded in the floor may therefore be referred to as "in-floor" conveyors. There are numerous significant differences between container conveyors and secondary packaging conveyors. In the case of container conveyors, containers typically weighing up to about 4 kilograms are moved at moderate to very high rates of speed, up to about 100 meters per minute, by chains that have a flat surface on which the container rests. Secondary packaging conveyors transport much heavier loaded objects weighing from about 15 kilograms up to about 100 kilograms or more at lower speeds, usually less than 20 meters per minute. Secondary packaging conveyors usually have chain links with flat surfaces on which packages rest where the cross section of the flat surface of the conveyor is smaller than the cross section of the surface of the conveyed object and the conveyed objects are situated directly on chain links during transport. Generally, falling or jamming of containers is not a problem for secondary packaging conveyors because of the slower speeds and because containers are conveyed on or inside of secondary packaging.

The purpose of lubricating container conveyors and secondary packaging conveyors is different. For container conveyors, the containers are often standing still while the conveyor quickly moves underneath them. Containers moved by container conveyors frequently experience large accelerations and decelerations. For example, a conveyed package may make abrupt changes in direction or transition from mass flow (moving in columns that are up to 40 containers wide or more) to single file. Therefore, it is frequently the case that containers will make accelerations and decelerations of up to forty fold in moving from one section of the conveyor to another. Under conditions of stopped containers with conveyors moving underneath them or conditions of rapid accelerations and decelerations, containers may fall over, jam, or be pushed together with sufficient force so as to marred or damaged. Thus, the main purpose of the lubricant is to permit higher speed operation by minimizing the falling and jamming of containers, while lubricating the equipment per se is either not a consideration or is at most a secondary consideration. For secondary packaging conveyor lubrication, emphasis is on reducing energy requirements of motors, reducing overheating of motors, and extending the lifetime of parts including the moving chain.

Historically, lubrication for both container conveyors and secondary packaging conveyors has been accomplished by application of dilute aqueous solutions of surfactants using spray or pumping equipment. Use of dilute aqueous lubricants typically requires use of large amounts of water on the conveying line, which causes an unduly wet environment near the conveyor line. The presence of large amounts of water promotes the growth of microbes, and typically a preservative must be added to retard biological growth, which is costly and also environmentally unfriendly. Finally, dilution errors can occur, leading to variations and errors in concentration of the aqueous dilute lubricant solution.

SUMMARY

Conveyor lubricant compositions that include oil in water emulsions are surprisingly effective for lubricating a conveyor that transports secondary packaging. The present disclosure relates to a method for lubricating secondary packaging conveyors using lubricant compositions that include oil in water emulsions.

In an embodiment, a lubricant composition is applied to the articulating chain and pin joint of the chain of a conveyor transporting objects weighing more than about 15 kilograms. The lubricant composition includes an oil in water emulsion.

In another embodiment, a lubricant composition is applied to the articulating chain and pin joint of the chain of a conveyor, wherein the conveyor transports crates of containers weighing more than about 15 kilograms. The lubricant composition includes an oil in water emulsion that contains at least one oil that is not a silicone oil. In an embodiment, the lubricant composition is free or substantially free of a silicone oil.

In another embodiment, a lubricant composition is applied to the articulating chain and pin joint of the chain of a conveyor transporting crates of containers weighing more than about 15 kilograms. The lubricant composition can consist of an oil in water emulsion.

DETAILED DESCRIPTION

Methods

Figure 1:
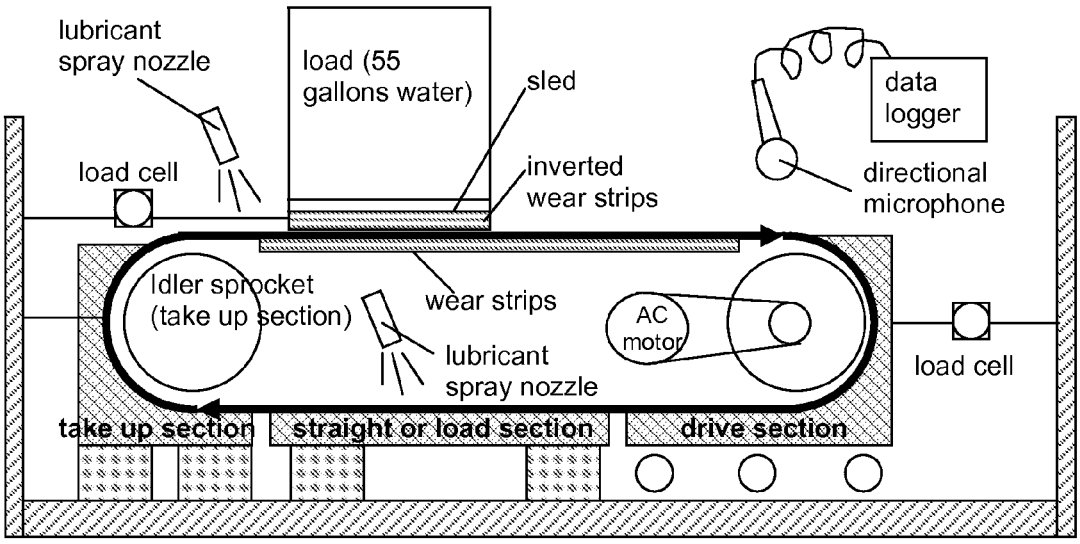
FIG. 1 shows a diagram of a short section of an "in floor" conveyor similar to that used for secondary packaging.

The present disclosure relates to methods for lubricating secondary packaging conveyors using lubricant compositions that include oil in water emulsions.

The lubricant compositions are applied to the load carrying conveyor chain links, and especially the articulating chain and pin joint. Again, in contrast to table top conveyors, the articulating chain and pin joint and the interface between chains and support structures are the important surfaces to lubricate, not the interface between the conveyor and the container.

The lubricant compositions can be applied diluted (or "wet") or undiluted (or "dry"). A diluted lubricant refers to a composition that has been diluted with water and then applied to the conveyor. When the lubricant composition is diluted, it is preferably diluted in a ratio of lubricant composition to water of between about 1:50 to about 1:4000, about 1:100 to about 1:2500, or between about 1:300 to about 1:1000 An undiluted lubricant refers to a composition that is not diluted before applying it to the conveyor.

Whether a diluted or undiluted lubricant is used, the lubricant composition may be applied continuously or intermittently. Continuously means the lubricant composition is dispensed constantly on to the conveyor chains with either no interruptions or with minimal interruptions. Intermittently means the lubricant composition is applied for a period of time and then not applied for a period of time which is more than about twice as long as the period of application. When the lubricant is applied intermittently, the composition is applied for a period of time ("on time") and then not applied for a period of time ("off time"). The ratio of on time to off time can be between about 1:10 and about 1:4000, between about 1:50 and about 1:2000, or between about 1:200 and about 1:1000. The lubricant application should be such that the composition provides effective lubrication over the entire time the conveyor is running, even when the lubricant is not actually being applied during the off time. Further, the lubricant preferably continues to lubricate even if water or other liquid is sprayed or spilled on it.

The rate of lubricant composition application in terms of active lubricant can be modified by changing the concentration of active lubricating oil or by changing the ratio of on time to off time or by changing the time weighted average dispensing rate of a continuously or intermittently operating metered diaphragm pump. Regardless of how the lubricant emulsion is applied, the lubricant application rate can be described in terms of amount of oil dispensed per unit length of chain per unit time. In an embodiment, lubricant application rates are between 1 and 100 mg of oil per meter of chain per hour of operation. Preferred lubricant application rates are between 6 and 60 mg of oil per meter of chain per hour of operation.

The lubricant compositions, whether diluted or undiluted, may be applied using spray nozzles, brushes, or "flicker" devices in which a plate mounted against a motor-driven rotating brush flicks the bristles as the brush rotates to generate a mist of droplets directed towards the chain.

When undiluted compositions are selected, they are preferably applied through a non-energized nozzle. A non-energized nozzle refers to a nozzle that provides a fine lubricant spray at relatively low flow rates (less than about 10 mL/sec at pressures less than about 50 psi) without requiring applied energy (for example high pressure, compressed air, or sonication) to break up the lubricant flow into small droplets. Non-energized nozzles are useful on spray dispensing systems that operate at relatively lower pressure (less than about 50 psi) and do not include either a high pressure lubricant line or a lubricant venting line.

The lubricant composition preferably has a viscosity of less than about 40, about 20, or about 10 centipoise.

As discussed above, secondary packaging refers to something that holds containers, for example crates and pallets. Containers include cartons, cans, bottles, Tetrapak™ packages, waxed carton packs, and other forms of containers. The containers can be different types of materials, such as metals, glasses, ceramics, papers, treated papers, waxed papers, composites, layered structures, and polymeric materials (e.g., especially polyolefins such as polyethylene, polypropylene, polystyrene, blends and laminates thereof, polyesters such as polyethyleneterephthalate and polyethylenenaphthalate, blends, and laminates thereof, polyamides, polycarbonates, etc).

Compositions

The lubricant compositions include an oil in water emulsion together with optional additional materials.

Oil

The primary lubricating component of the composition is an oil. "Oil" means a liquid that is substantially immiscible or insoluble in water (less than about 1000 ppm solubility). Useful oils may be mixtures of two or more discrete compounds. Preferable oils, whether as a single compound or mixture of compounds, are liquids at temperatures above about 0° C.

Exemplary oils include the following:

Water Insoluble Organic Compounds. The oil may be a water insoluble organic compound. In some embodiments, the water insoluble organic compound is not polydimethylsiloxane or a silicone compound. Further, a composition may be free of a polydimethylsiloxane or a silicone compound. In some embodiments, the water insoluble organic compound does not contain silicone, phosphorous, or sulfur heteroatoms.

Triglycerides. The oil may be a triglyceride. The term triglycerides refers to substances having the general formula:

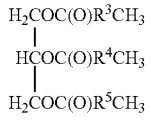

where $R^3$, $R^4$, and $R^5$ are independently linear or branched, saturated and/or unsaturated, optionally hydroxy- and/or epoxy-substituted residues with 6 to 22, e.g., 12 to 18 carbon atoms. The triglycerides can be of natural origin or produced synthetically. In an embodiment, the triglyceride has linear and saturated alkylene residues with chain length between 6 and 22 carbon atoms. Preferred triglycerides include the so-called Medium Chain Triglyceride or MCT oils, in which the majority of $R^3$, $R^4$, and $R^5$ groups are independently selected from linear, saturated alkyl residues containing between about 6 and about 12 carbons. Examples of MCT oils are the tri(capric/caprylic) acid esters of glycerine including those sold under the trade Myritol 331, Myritol 312, Myritol 318, (Cognis); Miglyol 812 N and Miglyol 812 (Sasol), and Lumulse CC33K (Lambent).

Synthetic Ester Oil. The oil may be a synthetic ester oil. Suitable synthetic ester oils include esters of monocarboxylic fatty acids and mono-, di- and poly-hydric alcohol compounds. Suitable monocarboxylic fatty acid components of the ester include benzoic acid, octanoic acid, nonanoic acid, decanoic acid, undecanoic acid, dodecanoic acid, myristic acid, palmitic acid, stearic acid, oleic acid, behenic acid, or mixture thereof. The esters can include any of a variety of alcohol moieties, such as monohydric fatty alcohols and di- and polyhydric compounds. Suitable monohydric alcohol components of the ester include primary aliphatic alcohols, such as aliphatic hydrocarbon alcohols, for example, methanol, ethanol, and linear and branched primary alcohols with 3 to 25 carbon atoms. Suitable di- and poly-hydric alcohol components of the ester include those containing from 2 to about 8 hydroxy groups such as alkylene glycols, e.g., ethylene glycol, diethylene glycol, neopentyl glycol, tetraethylene glycol, or mixture thereof. Additional suitable alcohol components of the ester include glycerine, erythritol, mannitol, sorbitol, glucose, sucrose, trimethylolpropane (TMP), pentaerythritol, dipentaerythritol, sorbitan, or mixture thereof.

Suitable synthetic ester oils include esters of di- and poly carboxylic acids and monohydric alcohol compounds. Suitable di- and poly carboxylic acid components of the ester include adipic acid, succinic acid, glutaric acid, sebacic acid, phthalic acid, isophthalic acid, trimellitic acid, and mixtures thereof. Suitable monohydric alcohol components of the ester include primary aliphatic alcohols, such as aliphatic hydrocarbon alcohols, for example, methanol, ethanol, and linear and branched primary alcohols with 3 to 25 carbon atoms.

Synthetic ester oils can include any of a variety of carboxylic acid and alcohol residues that provide a water insoluble (not capable to be dissolved in water to give clear solutions at concentrations greater than about 0.1% by weight at room temperature) ester that is a liquid, semi-solid, or a low melting solid. In preferred embodiment, the oil may be an oil including a synthetic ester oil, which has a melting point above about 0° C. so long as the mixture of oils has a melting point below about 0° C. or so long as the oil forms an emulsion that is stable at storage conditions at or slightly above 0° C. Preferred synthetic ester oils include synthetically produced triglyceride compounds and triesters of trimethylol propane such as trimethylol propane tricocoate, trimethylol propane tri(caprate/caprylate), and glycerine tri(caprate/caprylate).

Free Fatty Acid. The oil may be a free fatty acid. Suitable free fatty acids include octanoic acid, nonanoic acid, decanoic acid, undecanoic acid, dodecanoic acid, myristic acid, palmitic acid, stearic acid, oleic acid, behenic acid, or mixture thereof.

Hydrocarbon. The oil may include a synthetic or natural hydrocarbon compound. Suitable synthetic hydrocarbons include polybutenes such as Indopol™ (Ineos Oligomers, League City Tex.), hydrogenated polybutenes such as Panalane™ (Ineos Oligomers), poly(alpha olefins) such as SpectraSyn™ products (ExxonMobil Chemical, Houston Tex.), and synthetic isoparaffinic fluids such as Isopar™ (ExxonMobil Chemical).

Lubricating emulsion compositions preferably contain between about 0.01 wt-% to about 0.10 wt-% of oil if applied at a rate of about 60 g of lubricant composition per meter length of chain per hour, and contain between about 0.10 wt-% to about 20 wt-% of oil, about 0.25 to about 10 wt-% oil, or about 1.0 to about 4 wt-% oil if applied at a rate of about 1 g of lubricant composition per meter length of chain per hour. The amount of lubricating oil that is applied to conveyor chains per length per unit time is preferably between about 1 and about 200 mg/meter/hour, between about 2.5 and about 100 mg/meter/hour, or between about 10 and about 40 mg/meter/hour.

Emulsifiers

The present composition can include any of a variety of emulsifiers to emulsify the water insoluble oil. Useful emulsifiers include:

(1) alcohol ethoxylates, alcohol propoxylates, and alcohol ethoxylate propoxylates formed from the addition of ethylene oxide and/or propylene oxide to linear or branched long chain (C8 or greater) fatty alcohols or to alkyl substituted phenol compounds such as poly(ethylene oxide) undecyl ether, poly (ethylene oxide) ether with (C12-C15) linear primary alcohols, poly(ethylene oxide) ether with (C14-C15) linear primary alcohols, and ethoxylated propoxylated C8-10 alcohols. Examples of alcohol ethoxylate compounds include ceteareth-20 (Lumulse CS-20, available from Lambent), Tomadol 1-3 alcohol ethoxylate, Tomadol 25-7 alcohol ethoxylate, and Tomadol 45-13 alcohol ethoxylate and Tomadol 45-7 alcohol ethoxylate (available from Air Products, Inc., Allentown Pa.) and Antarox BL-214 (available from Rhodia, Cranbury N.J.), or a mixture of these surfactants;

(2) sorbitan esters with linear or branched long chain (greater than about 8 carbon atoms) fatty acids such as sorbitan monolaurate, sorbitan monopalmitate, sorbitan monostearate, and sorbitan monooleate (e.g., SPAN series 20, 40, 60, and 80, available from Uniqema, New Castle, Del. and Lumisorb SMO, available from Lambent Technologies, Gurnee Ill.), or a mixture of these surfactants;

(3) ethoxylated sorbitan esters with linear or branched long chain (greater than about 8 carbon atoms) fatty acids such as polyoxyethylene (20) sorbitan monolaurate (polysorbate 20), polyoxyethylene (20) sorbitan monopalmitate (polysorbate 40), polyoxyethylene (20) sorbitan monostearate (polysorbate 60), and polyoxyethylene (20) sorbitan monooleate (polysorbate 80) (e.g., TWEEN series 20, 40, 60, and 80, available from Uniqema, New Castle, Del.), or a mixture of these surfactants;

(4) ethoxylated castor oils such as PEG-5 castor oil, PEG-25 castor oil, and PEG-40 castor oil (e.g. Lumulse CO-5, Lumulse CO-25, and Lumulse CO-40 available from Lambent Technologies, Gurnee Ill.), or a mixture of these surfactants;

(5) long chain (greater than about 8 carbon atoms) fatty acid compounds including fatty acids derived from the saponification of vegetable and animal fats and oils such as tall oil fatty acid, coconut fatty acid, oleic acid, ricinoleic acid, and carboxylic acid terminated short chain (e.g., n=4) polymers of hydroxyl functional fatty acids such as ricinoleic acid and salts thereof (e.g. Hostagliss L4 available from Clariant Corporation, Mount Holly N.J.), or a mixture of these surfactants;

(6) phosphate ester compounds formed from esterification of phosphoric acid with linear or branched long chain (greater than about 8 carbon atoms) fatty alcohols, alcohol ethoxylates, alcohol propoxylates, alcohol ethoxylate propoxylates and ethoxylated linear and branched alkylphenol compounds and salts thereof such as poly(ethylene oxide) oleyl ether phosphate and a poly(ethylene oxide) C8-C10 alkyl ether phosphate (e.g. Lubrhophos LB400, Rhodafac PA/32, Rhodafac PA/35, and Rhodafac RA-600, available from Rhodia, Cranbury N.J.), or a mixture of these surfactants;

(7) phospholipid compounds such as lecithin, hydroxylated lecithin, and phosphate ester derivatives of mono- and di-esters of glycerine with linear or branched long chain (greater than about 8 carbon atoms) fatty acids and salts thereof (e.g. Phospholipon 80 and Alcolec Z-3 available from American Lecithin Company, Oxford Conn. or Phospholipid, Cologne, many and Lanchem PE-130K available from Lambent Technologies, Gurnee Ill.), or a mixture of these surfactants;

(8) mono- and di-esters of glycerine with linear or branched long chain (greater than about 8 carbon atoms) fatty acids, such as glycerol monooleate, glycerol monoricinoleate, glycerol monostearate, and glycerol monotallate (e.g. Lumulse GMO-K, Lumulse GMR-K, Lumulse GMS-K, and Lumulse GMT-K, available from Lambent Technologies, Gurnee Ill. and Tegin OV, available from Goldschmidt Chemical Corporation, Hopewell, Va.), or a mixture of these surfactants;

(9) EO-PO block copolymers such as poly(ethylene oxide)-poly(propylene oxide)-poly(ethylene oxide) block copolymers and polypropylene oxide)-poly(ethylene oxide)-poly(propylene oxide) block copolymers (e.g. Pluronic and Pluronic R series products available from BASF Corporation, Florham Park, N.J.), or a mixture of these surfactants;

(10) alcohol ethoxylates formed from the addition of ethylene oxide to linear and branched alkylphenol compounds such as poly(ethylene oxide) ether with nonyl phenol (e.g. Marlophen NP4 and Marlophen NP20 available from Sasol, Marl, many and Surfonic N95, available from Huntsman Chemical Corporation, The Woodlands, Tex.), or a mixture of these surfactants;

(11) alkylated mono-, di- and oligoglycosides containing 8 to 22 carbon atoms in the alkyl group and ethoxylated alkylated mono-, di- and oligoglycosides containing 8 to 22 carbon atoms in the alkyl group such as poly(D-glucopyranose) ether with (C8-C14) linear primary alcohols (e.g. Glucopon 425N/HH, available from Cognis North America, Cincinnati, Ohio), or a mixture of these surfactants;

(12) long chain (greater than about 8 carbon atoms) alkyl sulfonate and sulfate compounds such as octanesulfonic acid, sulfuric acid ester with lauryl alcohol, sulfuric acid ester with lauryl alcohol and salts thereof (e.g. Texapon K-12G and Texapon K-14S available from Cognis North America, Cincinnati Ohio), or a mixture of these surfactants;

(13) sulfonated succinic acid esters with long chain (greater than about 8 carbon atoms) alcohols and ethoxylated long chain alcohols such as the bis(2-ethylhexyl) ester of sulfosuccinic acid and the lauryl poly(ethylene oxide) ester of sulfosuccinic acid (e.g. Aerosol OT, available from Cytec Industries, Inc. Paterson N.J. and Texapon SB 3KC available from Cognis North America, Cincinnati Ohio), or a mixture of these surfactants;

(14) sulfuric acid esters of linear or branched long chain (greater than about 8 carbon atoms) alcohol ethoxylates, alcohol propoxylates, alcohol ethoxylate propoxylates and ethoxylated linear and branched alkylphenol compounds and salts thereof such as sodium dodecylpoly(oxyethylene) sulfate (e.g., Texapon N70 available from Cognis North America, Cincinnati Ohio), or a mixture of these surfactants;

(15) sulfonates of benzene, cumene, toluene and alkyl substituted aromatic compounds and salts thereof such as sodium alkyl benzene sulfonic acid (e.g. Nansa HS90/S, available from Huntsman Chemical Corporation, The Woodlands Tex.), or a mixture of these surfactants; (16) carboxylates of alcohol ethoxylates, alcohol propoxylates, alcohol ethoxylate propoxylates and ethoxylated linear and branched alkylphenol compounds and salts thereof such as poly(ethylene oxide) tridecyl alcohol ether carboxylic acid and sodium poly(ethylene oxide) lauryl ether carboxylate (e.g. Emulsogen DTC Acid and Emulsogen LS-24N from Clariant Corporation, Mount Holly N.J.), or a mixture of these surfactants;

(17) mono- and di-esters of glycerine with linear or branched long chain (greater than about 8 carbon atoms) fatty acid compounds further esterified with short chain di- and poly-carboxylic acid compounds, such as glycerol monostearate monocitrate (e.g. Grindsted Citrem 2-in-1 available from Danisco, Copenhagen Denmark), and mixtures of these surfactants;

(18) long chain (greater than about 8 carbon atoms) acyl amino acids, such as acyl glutamates, acyl peptides, acyl sarcosinates, acyl taurates, salts thereof, and mixtures of these surfactants;

(19) polyglyceryl monoesters with linear or branched long chain (greater than about 8 carbon atoms) fatty acids such as triglycerol monooleate (e.g. Lumulse PGO-K, available from Lambent Technologies, Gurnee Ill.), or a mixture of these surfactants;

(20) ethoxylated mono- and di-esters of glycerine with linear or branched long chain (greater than about 8 carbon atoms) fatty acids such as poly(oxyethylene) glyceryl monolaurate (e.g. Lumulse POE(7) GML and Lumulse POE(20) GMS-K, available from Lambent Technologies, Gurnee Ill.), or a mixture of these surfactants;

(21) mono- and di-esters of ethylene glycol and poly(ethylene glycol) with linear or branched long chain (greater than about 8 carbon atoms) fatty acids such as ethylene glycol distearate, PEG-400 monooleate, PEG-400 monolaurate, PEG-400 dilaurate, and PEG-4 diheptanoate (e.g. Lipo EGDS available from Lipo Chemicals, Paterson N.J., Lumulse 40-OK, Lumulse 40-L, and Lumulse 42-L available from Lambent Technologies, Gurnee Ill. and LIPONATE 2-DH, product of Lipo Chemicals, Inc., Paterson N.J.), or a mixture of these surfactants;

(22) amide compounds formed from linear or branched long chain (greater than about 8 carbon atoms) fatty acids such as coconut acid diethanolamide and oleic acid diethanolamide (e.g. Ninol 40-CO and Ninol 201, available from Stepan Corporation, Northfield Ill. and Hostacor DT, available from Clariant Corporation, Mount Holly, N.C.), or a mixture of these surfactants;

(23) ethoxylate compounds formed from the addition of ethylene oxide to amide compounds formed from linear or branched long chain (greater than about 8 carbon atoms) fatty acids such as poly(ethylene oxide) ether with coconut acid ethanolamide (e.g. Ninol C-5 available from Stepan Corporation, Northfield Ill.), or a mixture of these surfactants;

(24) nonionic silicone surfactants such as poly(ethylene oxide) ether with methyl bis(trimethylsilyloxy) silyl propanol (e.g. Silwet L77 available from Momentive Performance Materials, Wilton N.J.), or a mixture of these surfactants;

(25) fatty amine compounds such as oleyl diaminopropane and cocoalkyl diaminopropane (e.g. Duomeen OL and Duomeen CD available from Akzo Nobel Surfactants, Chicago Ill.) and lauryl dimethylamine (e.g. Genamin LA 302D available from Clariant, Mount Holly N.J.);

(26) a mixture of such emulsifiers.

Lubricating emulsion compositions preferably contain between about 0.004 wt-% to about 0.04 wt-% of emulsifier if applied at a rate of 60 g of lubricant composition per meter length of chain per hour, and preferably contain between about 0.04 wt-% to about 8 wt-% of emulsifier, about 0.10 to about 4 wt-% emulsifier or about 0.4 to about 1.6 wt-% emulsifier if applied at a rate of about 1 g of lubricant composition per meter length of chain per hour. The amount of emulsifier in the lubricant composition that is applied to conveyor chains per length per unit time is preferably between about 0.4 and about 80 mg/meter/hour, between about 1.0 and about 40 mg/meter/hour, or between about 4 and about 16 mg/meter/hour.

Forming the Emulsion

Emulsions are unstable and thus do not form spontaneously. There are two prevalent methods for formation of colloidal dispersions including emulsions which are generation of the dispersed phase in situ and introduction of the dispersed phase into the continuous phase with energy in processes including heating, shaking, stirring, high shear mixing, and microfluidization. Useful emulsions can be prepared by introduction of the dispersed phase into the continuous phase.

The processes used to prepare the emulsions can be any process as long as the product of the emulsification is an oil in water emulsion that provides effective lubrication properties and desired stability properties. Exemplary processes include high shear methods, so-called "catastrophic" emulsification processes, precipitation processes, and phase change processes such as the so-called PIT processes.

Although the terms colloid and emulsion are sometimes used interchangeably, emulsion tends to imply that both the dispersed and the continuous phase are liquid. A commonly referred to example of an emulsion is milk, in which most of the milk lipid is in the form of globules ranging in size from 0.1 to 15 um in diameter. By emulsion it is meant a colloidal system in which the dispersed phase is an oil with a melting point less than about 0° C., i.e. the disperse phase is a liquid, either in the form of a bulk liquid or in the form of the dispersed phase of an oil in water emulsion, at temperatures greater than about 0° C. The oil is dispersed in and remains separate from a liquid continuous phase which may be water, an aqueous solution, or another polar liquid in which the oil is insoluble, and wherein the particle size of the dispersed phase ranges between about 10 angstroms and 15 microns. Emulsions will be characterized by one or more of the following: is opaque or translucent, exhibits a Tyndall effect, and/or contains dispersed material that will not pass through a membrane.

An emulsifier is a substance which stabilizes an emulsion. Typically emulsifiers are amphipathic surface active compounds which possess both hydrophilic and hydrophobic moieties. The ratio of hydrophilic and hydrophobic moieties in a surfactant is commonly expressed as the hydrophilic-lipophilic balance or HLB. In the preparation of emulsions, it may be desirable to use more than one emulsifying compound in which case the emulsifier present in the greatest concentration may be referred to as the primary emulsifier and emulsifiers present in lower concentrations may be referred to as co-emulsifiers or secondary emulsifiers, or all of the emulsifiers present in a composition may be referred to as co-emulsifiers.

When dispersing oils or hydrophobic materials, formulators have found that emulsification systems made up of two or more emulsifiers tend to give better dispersion properties, for example more stable dispersions, than a single emulsifier. When formulating emulsions with two or more emulsifiers, it is typical to use emulsifiers with different HLB values, and to adjust the ratio of emulsifiers to achieve a composite HLB value that is most suitable for emulsifying the hydrophobic material. In the case that two or more emulsifiers with different HLB values are used, it may be the case that emulsifiers with low HLB values are insoluble in water and themselves meet the definition of oil as described above. Therefore some compounds included in a list of oils useful in the present compositions will also be included in a list of emulsifiers useful in the present composition.

Over time, emulsions tend to revert to the stable state of oil separated from water, a process which is retarded by emulsifiers. It is understood that a "stable emulsion" does not refer only to systems that are thermodynamically stable, but also includes systems in which the kinetics of decomposition have been greatly slowed, that is, metastable systems. Emulsions can decompose through processes of flocculation (aggregation of dispersed particles), creaming (migration of the dispersed particles to the top of the emulsion due to buoyancy), and coalescence (combination of dispersed droplets to form larger ones).

In certain embodiments, a stable emulsion does not physically phase separate, exhibit creaming or coalescence, or form precipitate. In an embodiment, the emulsion is sufficiently stable that it is stable under conditions at which a conveyor lubricant composition is stored and shipped. For example, in an embodiment, the present stable emulsion does not phase separate in one month at 4 to 50° C., or even in two months or three months at such temperatures.

Dialysis presents a simple test for insolubility of an oil in water. An oil can be considered insoluble in water if when an emulsion that includes the oil is dialyzed through a membrane with a molecular weight cut off of 1,000, the oil is retained in the interior of the dialysis tubing.

Because the densities of oils useful in the present composition are often greatly different than that of water, stabilization of fluid emulsions is favored by small particle sizes. Small particle size oil in water emulsions can be provided by the use of high shear processes, by the use of co-solvents, or they may be provided by certain compositions and concentrations of lipophilic oils with emulsifiers/and or anionic surfactants and water, or both co-solvents and high shear processes. For example, in the absence of high shear processing, addition of a mixture of lipophilic oil plus emulsifiers to stirring water plus hexylene glycol solution may give a stable emulsion with a small particle size whereas addition of the same mixture of oil and emulsifiers to water alone will not. Emulsions of the present compositions can have volume average particle sizes less than about 10 microns, e.g., less than about 3 microns, such as less than about 1 micron. For ease of application by spraying, an emulsion of the present composition can have a viscosity of about 40 cP or less.

Antimicrobial Agents

The composition may optionally include an antimicrobial agent to slow biological growth in the lubricant composition. Useful antimicrobial agents include disinfectants, antiseptics and preservatives. Non-limiting examples of useful antimicrobial agents include phenols including halo- and nitrophenols and substituted bisphenols such as 4-hexylresorcinol, 2-benzyl-4-chlorophenol and 2,4,4'-trichloro-2'-hydroxybiphenyl ether, organic and inorganic acids and its esters and salts such as dehydroacetic acid, peroxycarboxylic acids, peroxyacetic acid, methyl p-hydroxy benzoic acid, cationic agents such as aromatic or linear quaternary ammonium compounds, aldehydes such as glutaraldehyde, antimicrobial dyes such as is acridines, triphenylmethane dyes and quinones, isothiazolinone compounds such as 5-chloro-2-methyl-4-isothiazolin-3-one and 2-methyl-4-isothiazolin-3-one, fatty amine compounds such as oleyl diaminopropane, cocoalkyl diaminopropane, and lauryl dimethylamine, and halogens including iodine and chlorine compounds. The antimicrobial agents can be used in an amount sufficient to provide desired antimicrobial properties. For example, from 0 to about 20 weight percent, preferably about 0.5 to about 10 weight percent of antimicrobial agent, based an the total weight of the composition can be used.

Corrosion Inhibitors

The composition optionally includes a corrosion inhibitor. Useful corrosion inhibitors include phosphonates, phosphonic acids, triazoles, organic amines, alkanolamines, long chain fatty acid carboxylate alkanolammonium salts, polycarboxylic acids such as carboxylic diacids and triacids, ether amines, sorbitan esters, alkanolamides, sarcosinates, phosphate esters, zinc, nitrates, chromium, molybdate containing components, and borate containing components.

Hydrotropes

The composition optionally includes a hydrotrope to provide viscosity control and cold temperature stability of the concentrate. Examples of hydrotropes include the alkali salts of aromatic sulfonates including sodium linear alkyl naphthalene sulfonate, potassium linear alkyl naphthalene sulfonate, sodium xylene sulfonate, potassium xylene sulfonate, potassium or sodium toluene sulfonate, potassium or sodium cumene sulfonate, and so forth; n-octenyl succinic anhydride (NOS); ammonium cumene sulfonate; alkyl polyglucoside; and so forth. The above list is intended for illustrative purposes only and is not exhaustive. Hydrotropes are known to those of skill in the art and there are numerous types available for use.

Lubrication Additives

Lubrication additives include compounds that are soluble in oil, water or both and that enhance or improve the lubricity properties of the emulsion. Improving the lubricity properties of lubricating emulsions can provide beneficial effects including diminishment of the energy requirements for motors, diminishment of incidences of motors over heating or tripping out, and lower rates of wearing for surfaces in sliding contact. Lubrication additives may include compounds considered to be extreme pressure additives or boundary lubricant additives. Some simple emulsions herein do not include lubrication additives and have been found to be surprisingly effective for lubricating secondary packaging conveyors. Nevertheless, lubricant emulsion compositions may contain lubrication additives including boundary lubricity additives and "extreme pressure" additives.

There exists overlap between the set of "extreme pressure" additives and boundary lubricity additives and even in the field of tribology and lubrication, "extreme pressure" additives are often confused with boundary lubricity additives. An accepted definition of a boundary lubricity additive is an additive that reduces friction and wear by maintaining a physical boundary between contacting surfaces (generally in a liquid phase) and relies on the ability of molecules to adsorb onto the contacting surfaces thereby creating a boundary that maintains separation of the sliding surfaces. On the other hand, extreme pressure additives are defined as compounds of sulfur, chlorine, or phosphorus that prevent sliding metal surfaces from seizing under conditions of extreme pressure through reaction with the metal to form inorganic surface films that prevents the welding of opposing asperities.

While not wishing to be bound by theory, it is believed that advantageous lubrication additives in the present invention function as boundary lubricity additives rather than as "extreme pressure" additives. Preferred compositions include those which have no compounds that contain phosphorous, sulfur, or halogens that can react with metals in sliding contact to form inorganic surface films that prevent the welding of opposing asperities.

Preferred lubrication additives may be water soluble or may be compounds that are insoluble in water but soluble in the oil phase of an oil in water emulsion. Useful lubrication additives include alcohol ethoxylate carboxylates such as trideceth-7-carboxylic acid (available from Clariant Corp. under the tradename of SANDOPAN™ DTC acid) and oleyl ether 10 mole ethoxylate carboxylic acid (available from Clariant under the tradename Emulsogen™ COL 100), phosphate esters such as oleyl ether 4 mole ethoxylate phosphate ester (available from Rhodia under the tradename Lubrhophos™ LB-400), polyalkylene glycols such as polyethylene glycols, methoxypolyethylene glycols, and polypropylene glycols and derivatives of polyalkylene glycols. Derivatives of polyalkylene glycols include polyalkylene glycol esters and diesters, alcohol ethoxylates, alcohol propoxylates, alcohol ethoxylate/propoxylate compounds, ethoxylated sorbitan derivatives, and ethoxylated glycerine derivatives. Other useful lubrication additives include poly(ricinoleic acid) compounds such as Hostagliss L4 (available from Clariant Corp.), and fatty acid amide compounds such as Hostacor DT (available from Clariant Corp.).

Cosolvents

Water miscible liquids may optionally be employed as diluents in the compositions, including mono-, di- and poly functional alcohol compounds such as hexylene glycol, sec-butanol, ethanol, isopropanol, diacetone alcohol, cyclohexanol, propylene glycol, ethylene glycol, 2-ethyl hexanol, 2-methyl butanol, n-pentanol, ethylene glycol propyl ether, and glycerine, and polyalkylene glycol compounds such as triethylene glycol, dipropylene glycol, ethylene glycol monoethyl ether, diethylene glycol, propylene glycol methyl ether, diethylene glycol methyl ether, diethylene glycol ethyl ether, and dipropylene glycol methyl ether.

Other Adjuvants

The composition may optionally include one or more other adjuvants to modify the character or properties of the compositions. Examples of other commonly employed adjuvants include viscosity modifiers, soil anti-redeposition agents, preservatives, dyes, fragrances, anti-foaming agents, soil suspension and solubilizing agents, as well as penetrants, and so forth. One of ordinary skill in the art is well versed in the type of adjuvants employed in such lubricant compositions.

Laboratory Testing of the Effectiveness of "Dry" Lubricant Compositions for Lubricating Conveyors Transporting Containers in Secondary Packaging.

Off line laboratory test methods have been used to predict lubricant performance for transporting secondary packaging. But these test methods were used with "wet" lubricants and are irrelevant when predicting dry lubricant performance. For example, U.S. Pat. No. 6,696,394 (Ruhr et al) and U.S. Pat. No. 6,525,005 (Kravitz et al) describe the use of Falex pin and Vee block testing. In Falex Vee block testing, two steel test pieces each having straight sided "V" shaped cut outs are situated opposingly and pushed into a round cylindrical pin while it rotates. During this testing, the pin is submerged in a bath of recirculating lubricant composition at the point of contact with the Vee blocks which acts to keep the test pieces constantly wetted and to remove heat. In the case of "dry" lubricants (applied less than about 30% of the time the equipment is running and surfaces are in sliding contact), the water originally present in the "dry" lubricant composition (for example, water that acts as a continuous phase or "carrier" in the case of oil in water emulsions) tends to evaporate leaving a thin dry appearing film which is no longer effective to remove heat. Falex Vee block testing of "dry" lubricant produces conditions of high local temperature in which parts fail rapidly which is very unlike the conditions under which lubricants are used.

In order to evaluate "dry" lubricant compositions for intermittent "dry mode" application, performance characteristics including sound level and coefficient of friction between chains and wear strips were recorded on a short section of conveyor similar to that used for transporting crates of containers in commercial settings.

Definitions

As used herein, weight percent (wt-%), percent by weight, % by weight, and the like are synonyms that refer to the concentration of a substance as the weight of that substance divided by the weight of the composition and multiplied by 100. Unless otherwise specified, the quantity of an ingredient refers to the quantity of active ingredient.

As used herein, the term "about" modifying the quantity of an ingredient in the compositions or employed in the methods refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about", the claims include equivalents to the quantities.

By lipophilic compound, it is meant compounds which are insoluble in water and when mixed with water exist in a separate phase.

A colloid is defined by the Houghton-Mifflin American Heritage® Dictionary of the English Language as a system in which finely divided particles, which are approximately 10 to 10,000 angstroms in size, are dispersed within a continuous medium in a manner that prevents them from being filtered easily or settled rapidly.

For a more complete understanding of the compositions and methods, the following examples are given to illustrate some embodiments. These examples and experiments are understood as illustrative and not limiting. All parts are by weight, except where it is contrarily indicated.

EXAMPLES

Testing Apparatus

For the purposes of evaluating the feasibility of oil in water emulsions as lubricants for secondary packaging conveyors, a short section of conveyor similar to that used for secondary packaging "in floor" conveyors was constructed. The apparatus is shown in FIG. 1. Two parallel side by side chains are looped around a drive sprocket and a return (take up) sprocket. For simplicity, the load carrying portion of the chains were not in the floor but situated about 20 inches above the floor so that the return chains could be placed directly beneath them instead of at the approximately the same level. In this way only one sprocket is needed at either end. The loop of chain consisted of three sections—a drive section, a load bearing section, and a take up section. The drive section was on rollers and connected to an external frame through a load cell which provided a measurement of the total tension carried by the two loops of chain. The idler sprocket was fastened directly to the external frame. During experiments, the load bearing chain was weighted in such a way as to be pushed into the supporting wear strips to increase drag on the chain due to frictional forces. Weighting of the chain was provided by placing a 55 gallon polyethylene drum full of water on top of a platform (sled) which had as runners inverted UHMW (Ultra High Molecular Weight) polyethylene wear strips. The sled was connected to the apparatus frame through a load cell which held the sled stationary and provided a measurement of the frictional force between the sled and the chain. In this way it was possible to know the effectiveness of the lubricant for reducing the friction between chain and UHMW wear strip material. The testing device included a directional microphone connected to a datalogger that measured and logged the sound level (in dB). The sound level was indicative of the effectiveness of lubrication for articulating pins and links of the chain. Amp draw of the motor was also logged, however because the motor was substantially over powered for the apparatus this was found to be quite constant and not dependent upon the nature of the lubricant or even whether a lubricant was applied or not.

Example 1

Measurement of Lubrication Effectiveness

Lubricant compositions were applied to the section of conveyor as described above and shown in FIG. 1. During the experiment, the chain was weighted and pressed into UHMW (Ultra High Molecular Weight) polyethylene wear strips by placing a 55 gallon drum full of water on a sled which had additional UHMW wear strips as runners which rested directly on the chain. The total weight of the drum of water plus the sled was 250 Kg. Before beginning the experiment, the tension on each chain was adjusted using a force gauge such that a force of 45 to 55 pounds was required to lift the upper load bearing chain to a height of 6 to 8 inches above the wear strip at the midpoint between the drive sprocket and the idle sprocket. At the start of the experiment, emulsion lubricant compositions (Emulsion 1, 2, 3, A or B) were applied for 20 seconds from one spray nozzle per chain (delivering approximately 2.25 mL of lubricant composition per second) directed to the upper load bearing chain and then during the duration of the experiment lubricant compositions were applied for 5 seconds every 30 minutes from the same nozzle. In the case of Comparative Example C (conventional lubricant), a dilute aqueous lubricant solution (0.33 wt %) was applied constantly for the duration of the experiment. The noise level in dB was measured using a 2700 Model Impulse Sound Level Meter directional microphone (available from Quest Technologies, 510 Worthington Street, Oconomowoc Wis.,) and sound was recorded and logged once every 10 seconds during operation. The microphone was situated approximately 5 inches above the drive sprocket Preparation of Lubricant Composition Emulsion 1. A lubricating emulsion was prepared which contained 0.3 weight % of sorbitan monooleate (Lumulse SMO-K, available from Lambent Technologies, Gurnee Ill.), 0.2 weight % of castor oil 25 mole ethoxylate (Lumulse CO-25, available from Lambent Technologies), 2.5 weight % of glycerine tri(caprate/caprylate) (Lumulse CC-33K, available from Lambent Technologies), 0.06 weight % of Kathon CG-ICP II (product of Rohm and Haas) in deionized water. When measured using a Horiba 910 particle size analyzer, the volume average particle size of the emulsion was determined to be 0.214 microns and the number average particle size was 0.173 microns.

Emulsion 2. A lubricating emulsion was prepared which contained 0.51 weight % of ceteareth-20 (Lumulse CS-20, available from Lambent Technologies), 0.18 weight % of ethoxylated oleyl phosphate ester (Lubrhophos LB400, available from Rhodia Inc., Cranbury N.J.), 0.75 weight % of Hostacor DT (available from Clariant Corporation, Charlotte N.C.), 0.6 weight % of oleic acid, 2.06 weight % of trimethylol propane tri(caprate/caprylate) (Priolube 3970, available from Croda Inc., Edison N.J.), 0.06 weight % of p-chloro-m-cresol (Preventol CMK, available from Lanxess Corporation, Pittsburgh, Pa.), 0.88 weight % of isopropyl palmitate, and 0.10 weight % of Kathon CG-ICP II (product of Rohm and Haas) in deionized water. When measured using a Horiba 910 particle size analyzer, the volume average particle size of the emulsion was determined to be 0.139 microns and the number average particle size was 0.119 microns.

Emulsion 3. A lubricating emulsion was prepared which contained 1.50 weight % of poly(ricinoleic acid) (Hostagliss L4, available from Clariant Corporation), 0.50 weight % of Lubrophos LB400, 0.75 weight % of Hostacor DT, 1.25 weight % of trimethylol propane trioleate (Synative ES 2964, available from Cognis North America, Cincinnati Ohio), and 15.0 weight % of hexylene glycol in deionized water. When measured using a Horiba 910 particle size analyzer, the volume average particle size of the emulsion was determined to be 0.257 microns and the number average particle size was 0.222 microns.

Comparative Emulsion A. A silicone emulsion was prepared which contained 8.6 weight % of E2140FG silicone emulsion available from Lambent, Gurnee Ill. and 91.4% deionized water.

Comparative Emulsion B. A silicone emulsion was prepared according to Example 1 of US Patent Application 2006/0030497 (Sperling) which contained 5.0% Silwet L-7608 (product of Momentive, Wilton, Conn.), 5.0% Lambent E-2140FG, 4.6% Kathon CG-ICP II, 4.0% dipropylene glycol monomethyl ether (Dowanol DPM), and 81.4% DI water.

Comparative Lubricant C. A lubricant solution was prepared by diluting 0.33% of Sani-Glide (available from Ecolab, St. Paul Minn.) with 99.67% of DI water.

Figure 2:
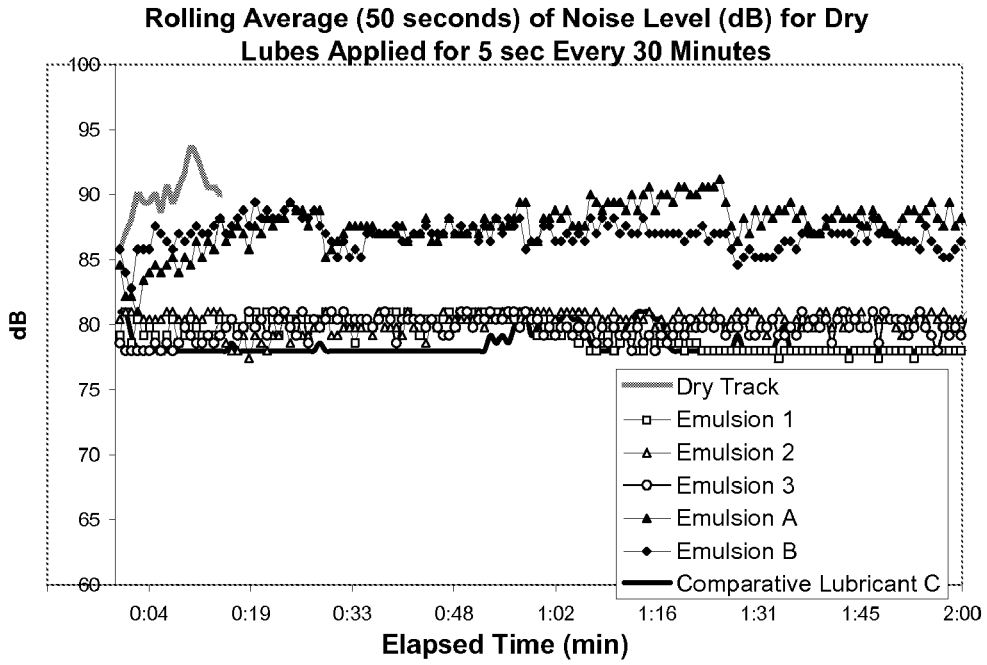
FIG. 2 shows the rolling average of noise levels for various dry conveyor lubricants.
Figure 3:
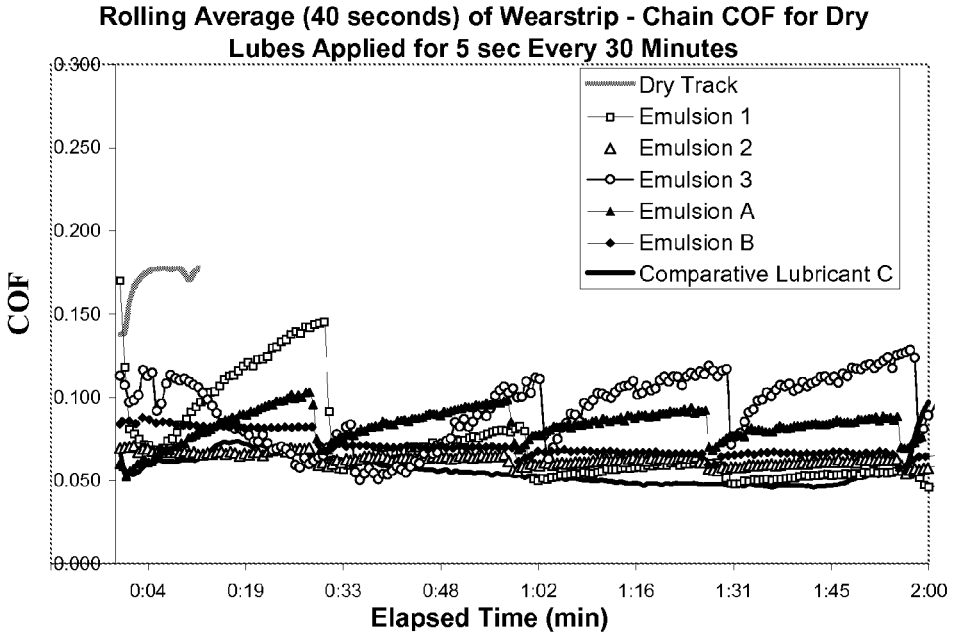
FIG. 3 shows the rolling average of the wear strip-chain coefficient of friction for various dry conveyor lubricants.

Results. A graph of the rolling time weighted average noise level (in dB) for Emulsions 1 and 2 and Comparative Emulsions A and B along with the noise level for the dry unlubricated conveyor and Comparative Lubricant C is shown as FIG. 2 and a graph of the rolling time weighted average coefficient of friction (COF, measured as the ratio of restraining force divided by total weight of sled and filled drum) is shown as FIG. 3.

Table 1 shows the average dB value and the average COF (between the weighted UHMW wear strip sled and the chain) for each emulsion sample measured for 30 minutes (between 1:00 hour and 1:30 of elapsed time) compared to that for the dry unlubricated conveyor (averaged between 5 and 10 minutes of operation).

TABLE 1

| Lubricant | average dB level | average COF |
|---|---|---|
| none (dry) | 90.9 | 0.177 |
| Emulsion 1 | 83.2 | 0.057 |
| Emulsion 2 | 80.6 | 0.061 |
| Emulsion 3 | 79.4 | 0.102 |
| Comparative Emulsion A | 89.2 | 0.085 |
| Comparative Emulsion B | 86.9 | 0.066 |
| Comparative Lubricant C | 79.1 | 0.049 |

Example 2

Evaluation of Compositions Based on Amp Draw

Emulsions 2 and 3 were applied to sections of a conveyor system in a field trial in comparison to the commercial lubricant product Sani-Glide (available from Ecolab Inc., St. Paul, Minn.).

Figure 4:
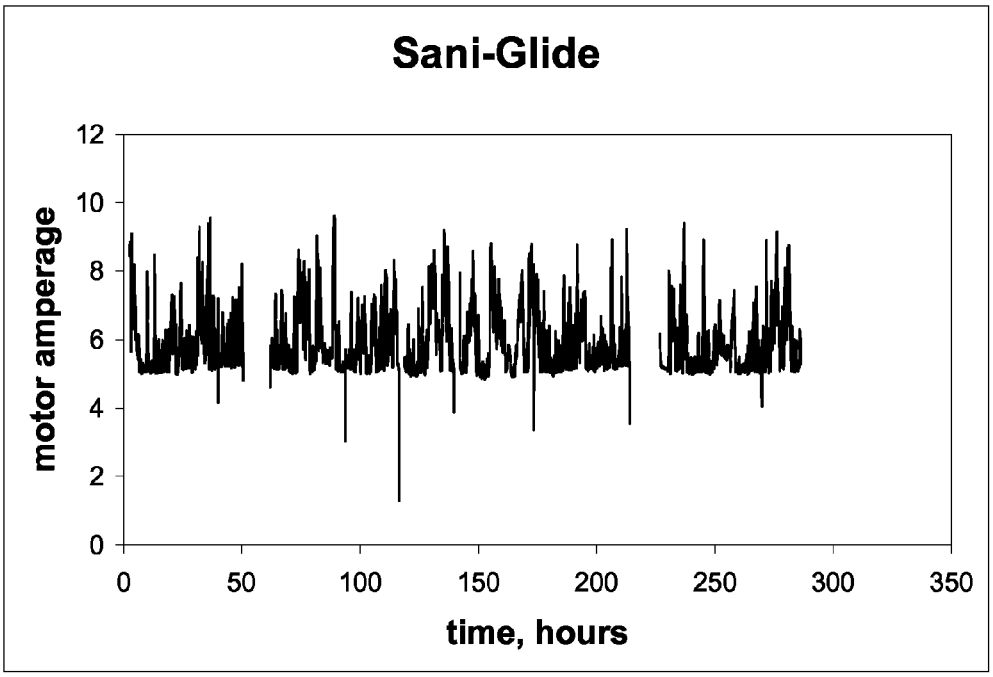
FIG. 4 shows the motor amperage plotted against time for the Unitizer section of the conveyor when Sani-Glide is applied as the lubricant.
Figure 5:
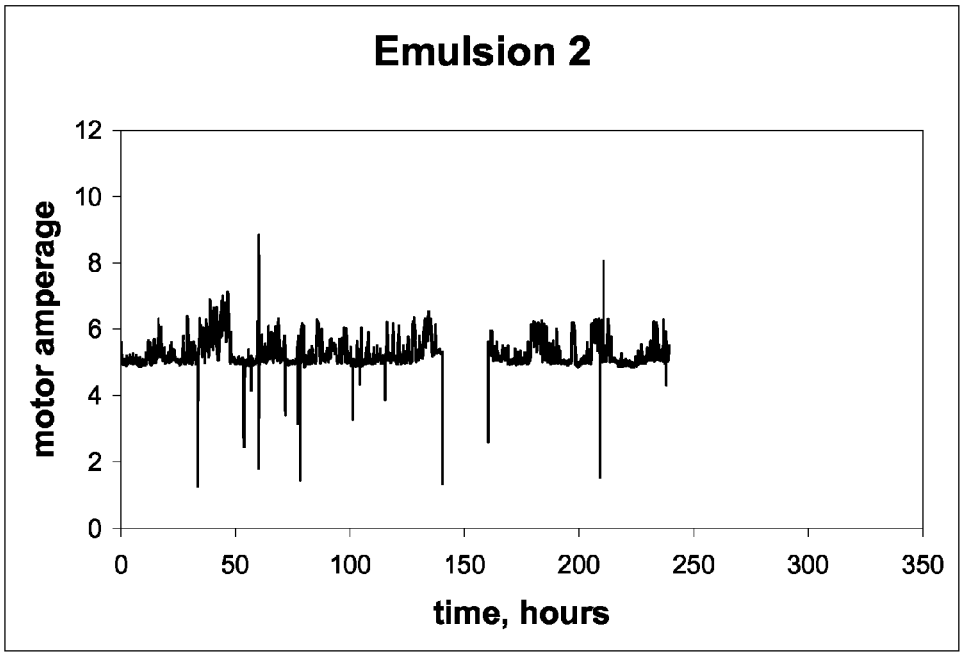
FIG. 5 shows the motor amperage plotted against time for the Unitizer section of the conveyor when Emulsion 2 is applied as the lubricant.
Figure 6:
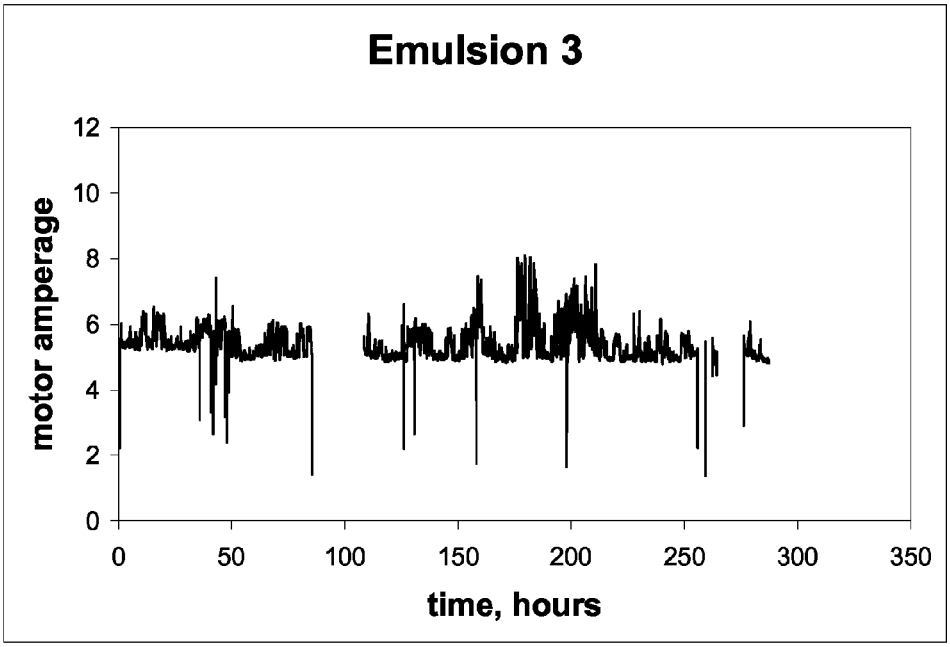
FIG. 6 shows the motor amperage plotted against time for the Unitizer section of the conveyor when Emulsion 3 is applied as the lubricant.

The first section of conveyor called the "Unitizer" section is a 100 foot straight section of chain operating in a cooler (3° C.) that transports stacks of high density polyethylene (HDPE) crates up to six high in which each crate contains four one gallon HDPE bottles of milk or orange juice products. The stack of crates weighs up to about 110 Kg. Crates are transported to a "Unitizer" which assembles stacks into pallet load cubes that are five to six crates high by 3 crates wide by 3 crates deep. The chain transports stacks of crates at a rate of about 40 feet per minute. The chain links are made from 1045 steel hardened to a Rockwell C hardness of 39 and the pins are made from 1045 steel hardened to a Rockwell C level of hardness of 54. The "Unitizer" conveyor is lubricated by four nozzles delivering 1 gallon of lubricant per hour at 30 psi during constant application, two at either end of each of two chains. For this evaluation, Emulsions 2 and 3 were applied intermittently with an application rate of 20 seconds every 60 minutes. During the 20 seconds of application, approximately 20 mL of lubricating emulsion was dispensed. The dispense rate of lubricating emulsion per hour was approximately 40 mL per chain. Comparatively, Sani-Glide was applied as a diluted 0.33 wt-% solution with constant application ("wet mode") using the same nozzles and delivery pressures in which case approximately 3800 mL of lubricating solution was dispensed per nozzle per hour. The dispense rate of dilute Sani-Glide solution per hour was approximately 7600 mL per chain. The two emulsions in dry mode were compared on the basis of amp draw to the conventional Sani-Glide product on the "Unitizer" section of conveyor for extended periods of time (between 190 and 300 hours of continuous running, not including stop time, for each composition). Throughout the application period, amperage data was collected on the main drive motor using a SmartReader Plus 3 Amp Data Logger and Amp Sensor (available from ACR Systems Inc., Surrey, British Columbia, Canada). Table 2 compares summarized amperage data collected for the "Unitizer" section of the line. Plots of amperage recorded every minute for the "Unitizer" section of the line are shown below as FIGS. 4, 5 and 6 for Sani-Glide, Emulsion 2, and Emulsion 3, respectively.

The comparison of Emulsions 2 and 3 to the commercial lubricant product Sani-Glide was repeated on a second section of conveyor called the "Load Out" section. The "Load Out" section is a 75 foot section of chain that has 180 degrees of bend, also operating in a cooler (3° C.) at a rate of about 40 feet per minute. The purpose of the "Load Out" conveyor section is to transport stacks of crates of various refrigerated dairy products from various "pick lanes" to waiting trucks. The materials of construction for the "Load Out" conveyor section are the same as for the "Unitizer" conveyor section. The "Load Out" conveyor section is lubricated by four nozzles delivering 1 gallon of lubricant per hour at 30 psi during constant application, two at either end of each of two chains. For this evaluation, Emulsions 2 and 3 were applied intermittently with an application rate of 20 seconds every 60 minutes. During the 20 seconds of application, approximately 20 mL of lubricating emulsion was dispensed. The dispense rate of lubricating emulsion per hour was approximately 40 mL per chain. Comparatively, Sani-Glide was applied as a diluted 0.32 wt-% solution with constant application ("wet mode") using the same nozzles and delivery pressures in which case approximately 3800 mL of lubricating solution was dispensed per nozzle per hour. The dispense rate of dilute Sani-Glide solution per hour was approximately 7600 mL per chain. The two emulsions in dry mode were compared on the basis of amp draw to the conventional Sani-Glide product on the "Load Out" section of conveyor for extended periods of time (between 200 and 300 hours of continuous running, not including stop time, for each composition on each section). Throughout the application period, amperage data was also collected on the main drive motor. Table 3 compares summarized amperage data collected for the "Load Out" section of the line.

TABLE 2

"Unitizer" Line Amperage Data

| Composition | Sani-Glide | Emulsion 2 | Emulsion 3 |
|---|---|---|---|
| Application method | wet mode | Dry mode | dry mode |
| Average motor amperage | 5.9 | 5.3 | 5.4 |
| Hours run | 255 | 218 | 288 |
| Number of amperage spikes (over 7 amps) per hour | 8.17 | 0.05 | 0.97 |

TABLE 3

"Load Out" Line Amperage Data

| Composition | Sani-Glide | Emulsion 2 | Emulsion 3 |
|---|---|---|---|
| Application method | wet mode | Dry mode | dry mode |
| Average motor amperage | 5.1 | 4.1 | 3.9 |
| Hours run | 279 | 190 | 255 |
| Number of amperage spikes (over 7 amps) per hour | 12.08 | 0.03 | 0.15 |

Example 3

Emulsion 4. A lubricating emulsion was prepared which contained 2.5 weight % of ceteareth-20 (Lumulse CS-20, available from Lambent Technologies), 0.50 weight % of soy lecithin (Alcolec XTRA-A, available from American Lecithin Company, Oxford Conn.), 2.22 weight % of oleic acid, 7.78 weight % of glycerine tri(caprate/caprylate) (Lumulse CC33K available from Lambent Technologies), 0.13 weight percent monoethanolamine, and 1.0 weight percent of Kathon EDC (product of Rohm and Haas) in deionized water.

The foregoing summary, detailed description, and examples provide a basis for understanding the compositions and methods and some specific embodiments. The above information is not intended to be limiting. The invention resides in the claims.

We claim:

1. A method of lubricating conveyors comprising: applying a lubricant composition to the articulating chain and pin joint of the chain of a conveyor wherein the conveyor transports objects weighing more than about 15 kilograms, and the lubricant composition comprises an oil in water emulsion where at least one oil is not a silicone compound.

2. The method of claim 1, wherein the oil in water emulsion comprises at least one oil that is not an organic compound of silicone, phosphorous, or sulfur.

3. The method of claim 1, wherein the lubricant composition is applied through non-energized nozzles.

4. The method of claim 1, wherein the lubricant composition has a viscosity of less than about 20 centipoise.

5. The method of claim 1, wherein the lubricant composition is applied intermittently.

6. The method of claim 5, wherein the lubricant composition is applied for a period of time and then not applied for a period of time and the ratio of application time to non-application time is between 1:10 and 1:4000.

7. The method of claim 1, wherein the composition further comprises an additive selected from the group consisting of antimicrobial agents, corrosion inhibitors, hydrotropes, lubrication additives, cosolvents, viscosity modifiers, anti-redeposition agents, preservatives, dyes, fragrances, anti-foaming agents, soil suspension agents, solubilizing agents, penetrants, and mixtures thereof.

8. The method of claim 1, wherein the lubricant composition further comprises a free fatty acid compound.

9. The method of claim 1, wherein the lubricant composition further comprises an alkanolamine compound.

10. The method of claim 1, wherein the lubricant composition further comprises an alkanolamide compound.

11. The method of claim 1, wherein the lubricant composition further comprises a phosphate ester.

12. The method of claim 1, wherein the lubricant composition further comprises an anionic surfactant.

13. The method of claim 1, wherein the lubricant composition further comprises a preservative.

14. The method of claim 1, wherein the lubricant composition further comprises a boundary lubricant additive.

15. The method of claim 1, wherein the lubricant composition further comprises an extreme pressure additive.

16. The method of claim 1, wherein the oil is selected from the group consisting of water insoluble organic compounds, triglycerides, synthetic ester oils, free fatty acid, hydrocarbon, and mixtures thereof.

17. The method of claim 1, wherein the oil is a synthetic ester oil.

18. The method of claim 1, wherein the oil is a triglyceride.

19. The method of claim 1, wherein the oil is a triester of trimethylol propane.

20. The method of claim 1, wherein emulsion has a volume average particle size less than about 300 nm.

21. The method of claim 1, wherein the emulsion is free from phase separation for greater than about 3 months at 4° C.

22. The method of claim 1, wherein the object is selected from the group consisting of crates, pallets, and secondary packaging.

23. The method of claim 1, wherein the lubricant composition comprises lecithin.

24. A method of lubricating conveyors for crates of containers comprising: applying a lubricant composition to the articulating chain and pin joint of the chain of a conveyor, wherein the conveyor transports crates of containers weighing more than about 15 kilograms and the lubricant composition comprises an oil in water emulsion and the composition is free of silicone oil.

25. A method of lubricating conveyors for crates of containers comprising: applying a lubricant composition to the articulating chain and pin joint of the chain of a conveyor, wherein the conveyor transports crates of containers weighing more than about 15 kilograms and the lubricant composition consists of an oil in water emulsion.

* * * * *